US012168826B2

(12) United States Patent
Noh et al.

(10) Patent No.: US 12,168,826 B2
(45) Date of Patent: Dec. 17, 2024

(54) PLATING WEIGHT CONTROL DEVICE AND CONTROL METHOD

(71) Applicant: POSCO, Pohang-si (KR)

(72) Inventors: Ilhwan Noh, Pohang-si (KR); Taein Jang, Pohang-si (KR); Won-Ho Lee, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 581 days.

(21) Appl. No.: 17/278,141

(22) PCT Filed: Sep. 20, 2019

(86) PCT No.: PCT/KR2019/012215
§ 371 (c)(1),
(2) Date: Apr. 27, 2021

(87) PCT Pub. No.: WO2020/060273
PCT Pub. Date: Mar. 26, 2020

(65) Prior Publication Data

US 2021/0348258 A1 Nov. 11, 2021

(30) Foreign Application Priority Data

Sep. 21, 2018 (KR) ..... 10-2018-0114320

(51) Int. Cl.
*C23C 2/00* (2006.01)
*C23C 2/16* (2006.01)
(Continued)

(52) U.S. Cl.
CPC ..... *C23C 2/16* (2013.01); *C23C 2/00344* (2022.08); *C23C 2/26* (2013.01); *C23C 2/40* (2013.01); *C23C 2/51* (2022.08)

(58) Field of Classification Search
CPC ..... C23C 2/00; C23C 2/003; C23C 2/00344; C23C 2/06; C23C 2/12; C23C 2/14;
(Continued)

(56) References Cited

U.S. PATENT DOCUMENTS 4,135,006 A * 1/1979 Readal ..... G05D 5/03 73/150 R
7,840,303 B2 * 11/2010 Kayama ..... C23C 2/51 427/9

(Continued)

FOREIGN PATENT DOCUMENTS

CN 101545085 9/2009
CN 103469137 12/2013

(Continued)

OTHER PUBLICATIONS

Machine translation of CN 106167887 A (Year: 2016).*

(Continued)

*Primary Examiner* — M. N. Von Buhr
(74) *Attorney, Agent, or Firm* — CANTOR COLBURN LLP

(57) ABSTRACT

An apparatus for controlling coating weight of a steel sheet by using an air knife includes: an air knife condition derivation unit configured to derive a first air knife gap and a final air knife pressure for target coating weight, and derive a second air knife gap for achieving the target coating weight at a current air knife pressure; and an air knife gap compensation unit configured to determine a final air knife gap according to a gap compensation amount that is a difference between the second air knife gap and the first air knife gap and a gap compensation ratio based on an air knife pressure variation amount for a control period, in which the control period is a period for updating an air knife condition for the target coating weight.

8 Claims, 5 Drawing Sheets

(51) Int. Cl.
*C23C 2/26* (2006.01)
*C23C 2/40* (2006.01)

(58) Field of Classification Search
CPC .. C23C 2/16; C23C 2/18; C23C 2/185; C23C 2/20; C23C 2/26; C23C 2/40; C23C 2/50; C23C 2/51; C23C 4/14; C25D 7/0692; B05C 11/06; B65H 2301/41414; D21H 5/007; D21H 25/16; G05B 2219/45013
See application file for complete search history.

(56) References Cited

U.S. PATENT DOCUMENTS

| | | | | |
|---|---|---|---|---|
| 9,289,821 | B2 * | 3/2016 | Lee | B22D 11/0622 |
| 2004/0050323 | A1 | 3/2004 | Chae | |
| 2021/0348259 | A1 * | 11/2021 | Noh | C23C 2/00 |

FOREIGN PATENT DOCUMENTS

| | | |
|---|---|---|
| CN | 104846306 | 8/2015 |
| CN | 106167887 | 11/2016 |
| CN | 107130199 | 9/2017 |
| CN | 108396275 | 8/2018 |
| CN | 108546897 | 9/2018 |
| JP | 2010126746 | 6/2010 |
| JP | 2016176107 | 10/2016 |
| JP | 2017088960 | 5/2017 |
| KR | 20020049465 | 6/2002 |
| KR | 20030053816 | 7/2003 |
| KR | 100815814 | 3/2008 |
| KR | 20150022406 | 3/2015 |
| KR | 20200034481 | 3/2020 |
| KR | 20200034482 | 3/2020 |
| WO | 2008078910 | 7/2008 |

OTHER PUBLICATIONS

Machine translation of KR 2015-0022406 A (Year: 2015).*
Adams, et al., Coating mass control on No. 2 galvanizing line at LTV Steel's Indiana Harbor works, Iron and Steel Engineer, AISE Steel Technology, vol. 73, No. 1, Jan. 1996, pp. 22-29.
European Search Report—European Application No. 19861449.7 issued on Sep. 23, 2021, citing KR 2015-0022406 and Adams, et al.
International Search Report—PCT/KR2019/012215 dated Dec. 30, 2019.
PCT Written Opinion—PCT/KR2019/012215 issued on Dec. 30, 2019, citing JP 2010-126746, KR 10-2003-0053816, JP 2016-176107, KR 10-0815814, and US 2004-0050323.
Lijun, Application of the Coating Weight Control Model for Continuous Galvanizing Line (CGL) at Baosteel, China Academic Journal Electronic Publishing House, vol. 4, 2007.
So et al., Numerical Simulation of an Impinging Jet with Various Nozzle-to-strip Distances in the Air-knife System, Corrosion Science and Technology, vol. 9, No. 6, 2010, pp. 239-246.
Chinese Patent Publication—Chinese Application No. 201980066604.7 issued on May 26, 2023, citing WO 2008/078910, CN 108546897, CN 106167887, and US 2004/0050323.

* cited by examiner

PLATING WEIGHT CONTROL DEVICE AND CONTROL METHOD

TECHNICAL FIELD

The present disclosure relates to a coating weight control apparatus and a coating weight control method.

BACKGROUND ART

A hot-dipping process is a process of producing a plated steel sheet with improved corrosion resistance/abrasion resistance/heat resistance and the like by plating a molten metal on a surface of a hot-rolled or cold-rolled steel sheet. For example, as the plated steel sheet, there is a galvanized steel sheet, and the galvanized steel sheet is variously used in home appliances, automobiles, buildings, and the like.

The hot dip galvanizing process consists of several unit sections for the purpose of heat treatment, plating, and the like. Among them, in the plating section, a steel sheet sequentially passes through a plating pot (zinc pot) containing molten zinc, an air knife, and a cooling device, and a zinc plating layer is formed on a surface of the steel sheet. In the plating section, the air knife is a facility for controlling a thickness or coating weight of a plating layer on the surface, and adjusts a pressure of gas (air jet) sprayed and a gap between the steel sheet and the air knife for accurately controlling coating weight.

When the coating weight is not accurately controlled, the plating process is performed with higher target coating weight than ordered coating weight in order to prevent the actual coating weight from being less than the ordered coating weight, and zinc is unnecessarily consumed. In order to prevent this, it is necessary to accurately control coating weight, and the coating weight is measured after the plating layer is solidified, so that a very large measurement delay occurs. Accordingly, there is a limit in general feedback control performance.

A coating weight control in the related art is mainly manually performed by an operator. Recently, the coating weight control is being automated by controlling an air knife using a prediction model and the like. For the automation of the coating weight control, an air knife operation condition instructed by a control system needs to be rapidly and accurately reflected to a facility. However, when an operation condition, particularly, target coating weight, of the air knife is changed, the response of the pressure is slow depending on a current value and a target control value, so that it takes time to follow the instructed value, and an control error is relatively large.

The above information disclosed in this Background section is only for enhancement of understanding of the background of the invention, and therefore it may contain information that does not form the prior art that is already known in this country to a person of ordinary skill in the art.

DISCLOSURE

Technical Problem

The present invention provides a coating weight control apparatus and a coating weight control method which are capable of compensating for a control response of an air knife derivation pressure.

Technical Solution

According to one characteristic of the invention, an apparatus for controlling coating weight of a steel sheet by using an air knife includes: an air knife condition derivation unit configured to derive a first air knife gap and a final air knife pressure for target coating weight, and derive a second air knife gap for achieving the target coating weight at a current air knife pressure; and an air knife pressure response compensation unit configured to determine a final air knife gap according to a gap compensation amount that is a difference between the second air knife gap and the first air knife gap and a gap compensation ratio based on an air knife pressure variation amount for a control period, in which the control period is a period for updating an air knife condition for the target coating weight.

When the control period is equal to or shorter than a pressure response time period, the air knife pressure response compensation unit may calculate the gap compensation ratio based on the air knife pressure variation amount for the control period, and when the control period is longer than the pressure response time period, the air knife pressure response compensation unit may set the gap compensation ratio to zero, and the pressure response time period may be the time period for which the current air knife pressure reaches the final air knife pressure.

When the control period is equal to or shorter than the pressure response time period, the air knife pressure response compensation unit may calculate the gap compensation ratio based on a value obtained by dividing the control period by the pressure response time period.

The gap compensation ratio may follow an equation below, $$(\text{gap compensation ratio})=1-Tc/2Tp,(Tp>=Tc)$$

$$(\text{gap compensation ratio})=0,(Tp<Tc),$$

Tc may be the control period, and Tp may be the pressure response time period.

The air knife pressure response compensation unit may multiply the gap compensation amount and the gap compensation ratio, and calculate the final air knife gap by adding the value obtained by the multiplication to the first air knife gap.

The air knife pressure response compensation unit may multiply the gap compensation amount and the gap compensation ratio, and calculate the final air knife gap by adding a quantization result of the value obtained by the multiplication to the first air knife gap.

When an air knife pressure change rate within one control period is equal to or larger than a predetermined threshold rate, the air knife pressure response compensation unit may derive a third air knife gap for reaching the target coating weight at a current air knife pressure, and determine a final air knife gap according to a gap compensation amount that is a difference between the third air knife gap and the first air knife gap and the gap compensation ratio.

According to another characteristic of the invention, a method of controlling coating weight of a steel sheet by using an air knife includes: deriving, by a coating weight control apparatus, a first air knife gap and a final air knife pressure for target coating weight; deriving, by the coating weight control apparatus, a second air knife gap for achieving the target coating weight at a current air knife pressure; calculating, by the coating weight control apparatus, a gap compensation amount that is a difference between the second air knife gap and the first air knife gap; calculating, by the coating weight control apparatus, a gap compensation ratio based on an air knife pressure variation amount for a control period; and determining, by the coating weight control apparatus, a final air knife gap based on the gap compensation amount and the gap compensation ratio, in which the control period is a period for updating an air knife condition for the target coating weight.

The calculating of the gap compensation ratio may include: when the control period is equal to or shorter than a pressure response time period, calculating the gap compensation ratio based on the air knife pressure variation amount for the control period, and when the control period is longer than the pressure response time period, setting the gap compensation ratio to zero, and the pressure response time period may be the time period for which the current air knife pressure reaches the final air knife pressure.

The calculating of the gap compensation ratio when the control period is equal to or shorter than the pressure response time period may include calculating the gap compensation ratio based on a value obtained by dividing the control period by the pressure response time period.

The gap compensation ratio follows an equation below, $$(\text{gap compensation ratio})=1-Tc/2Tp,(Tp>=Tc)$$

$$(\text{gap compensation ratio})=0,(Tp<Tc),$$

Tc may be the control period, and Tp may be the pressure response time period.

The determining of the final air knife gap may include multiplying the gap compensation amount and the gap compensation ratio, and calculating the final air knife gap by adding the value obtained by the multiplication to the first air knife gap.

The determining of the final air knife gap may include multiplying the gap compensation amount and the gap compensation ratio, and calculating the final air knife gap by adding a quantization result of the value obtained by the multiplication to the first air knife gap.

The method may further include: when an air knife pressure change rate within one control cycle is equal to or larger than a predetermined threshold rate, deriving a third air knife gap for reaching the target coating weight at a current air knife pressure; and determining a final air knife gap according to a gap compensation amount that is a difference between the third air knife gap and the first air knife gap and the gap compensation ratio.

Advantageous Effects

Through the exemplary embodiment, it is possible to compensate for a control response of an air knife pressure, and through this, it is possible to perform an operation closer to the ordered coating weight, thereby providing an effect of reducing zinc consumption.

MODE FOR INVENTION

Figure 1:
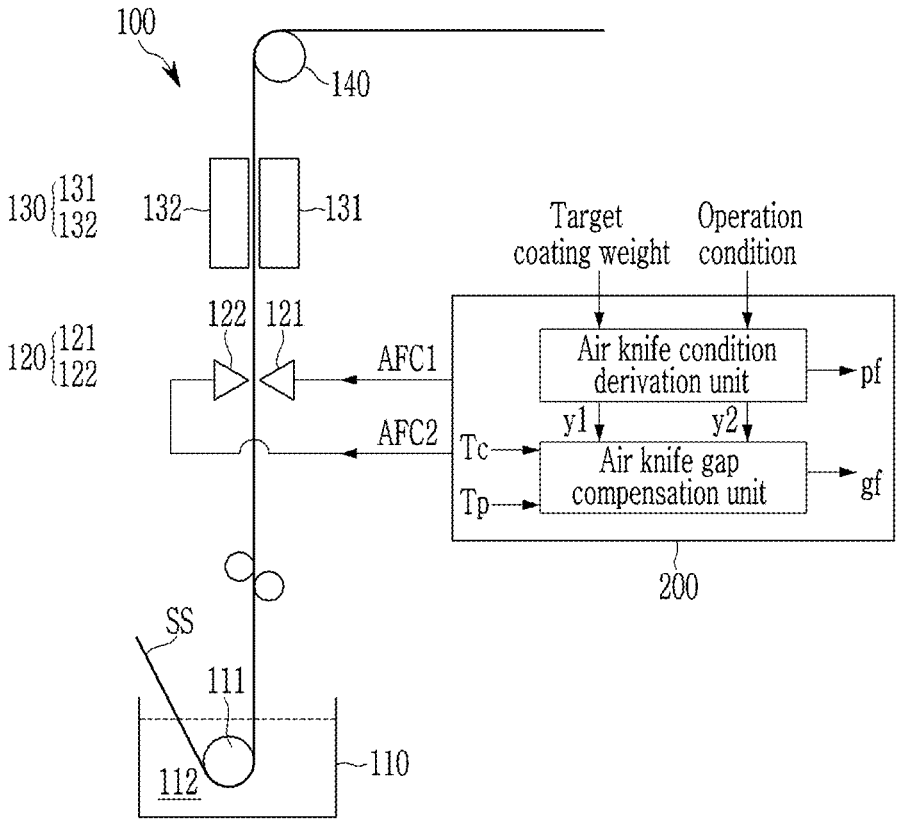
FIG. 1 is a diagram illustrating a plating device and a coating weight control apparatus according to an exemplary embodiment.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

A factor which a coating weight control system adjusts for coating weight control is a gap and a pressure of an air knife. Among them, the gap of the air knife is controlled by a machine device in a motor-screw method and the like, so that the gap of the air knife accurately follows an instruction value of the gap provided by the coating weight control system at a high response speed. However, in the case of the pressure, the method of controlling the pressure is various depending on a used fluid, and the pressure has slow control response, so that an error is relatively large. When N2 is used among the GI steel sheet producing methods, a pressure response of N2 is slow, so that coating weight may be controlled by putting more weight on the gap than the pressure. It is typical to use N2 in the GI production, but there is a case of using air. However, even in this case, a pressure response is slower than a required response, and even in the case where N2 is used through a blower with improved performance, the pressure response is still slower than the required response.

In the exemplary embodiment, a response delay and an error occurring in the pressure control for controlling coating weight are compensated by using a gap.

FIG. 1 is a diagram illustrating a plating device and a coating weight control apparatus according to an exemplary embodiment.

A plating device 100 includes a plating pot 110, a wiping part 120, and a cooling part 130. In the exemplary embodiment, the plating device 100 may be a hot dip galvanizing device.

The plating pot 110 is for the purpose of hot-dipping a steel sheet SS, and the steel sheet SS guided to the plating pot 110 is immersed in a molten metal 112 while passing a sink roll 111 disposed in the plating pot 110 to perform a hot dipping process. A travelling direction of the steel sheet SS is changed by the sink roll 111, so that the steel sheet SS moves to the top of the plating pot 110. The steel sheet SS of which the surface is plated by the molten metal 112 within the plating pot 110 is withdrawn through the upper portion of the plating pot 110. The steel sheet SS is manufactured into a plated steel sheet via the wiping part 120 and the cooling part 130 sequentially disposed in the travelling direction. The steel sheet SS cooled through the cooling part 130 proceeds to a subsequent process through a tension roll 140.

In the exemplary embodiment, as a plating solution, zinc, a zinc alloy, aluminum, and/or an aluminum alloy may be used.

The wiping part 120 is disposed on one surface or both surfaces of the steel sheet at the rear end of the plating pot 110 in the travelling direction of the steel sheet SS to control coating attachment weight of the steel sheet. The wiping part 120 includes air knives 121 and 122, and the air knives 121 and 122 spray gas with air knife pressure to the plating layer attached to the surface of the steel sheet SS at a distance spaced by an air knife gap to control coating attachment weight. For example, the air knives 121 and 122 have bodies which are extended in a width direction of the steel sheet SS and inside which cryogenic liquid is circulated, and a tip (not illustrated) inclined by an air knife angle with respect to the coating layer of the steel sheet SS may be formed at the front end of the body. The gas sprayed from the air knife may be air, nitrogen, and the like.

Each of the air knives 121 and 122 may control the air knife gap and pressure according to control signals AFC1 and AFC2 generated in the coating weight control apparatus 200.

The cooling part 130 may cool the steel sheet SS through mist spray or air spray to the coating layer on the surface of the steel sheet SS. For example, the cooling bodies 131 and 132 may include cooling rolls (not illustrated) which are extended in a width direction of the steel sheet and inside which cryogenic liquid is circulated, and which is pressurized by the plating layer on the surface of the steel sheet to apply cold air. The plurality of cooling rolls may be disposed in multiple stages at an interval in the travelling direction of the steel sheet SS.

The coating weight control apparatus 200 includes an air knife condition derivation unit 210 and an air knife gap compensation unit 220.

The air knife condition derivation unit 210 receives an input of target coating weight and an operation condition, derives a first air knife gap g1 and a final air knife pressure pf for the target coating weight, and derives a second air knife gap g2 for achieving the target coating weight at the current air knife pressure.

The air knife gap compensation unit 220 receives a control period Tc, a pressure response time period Tp, and the first and second air knife gaps g1 and g2, and determines a final air knife gap based on a gap compensation amount (g2−g1) that is a difference between the second air knife gap and the first air knife gap and a gap compensation ratio. The control period Tc is the period for updating the air knife condition for the target coating weight. The pressure response time period Tp is the time period taken for the current air knife pressure to reach the final air knife pressure for the target coating weight.

When the control period Tc is equal to or shorter than the pressure response time period Tp, the gap compensation ratio is calculated based on an air knife pressure variation amount for the control period Tc. When the control period Tc is longer than the pressure response time period Tp, the gap compensation ratio may be "0". For example, the air knife gap and the air knife pressure among the air knife conditions are updated at every control period Tc, and when the just before control period is the same as the target coating weight, the air knife gap and pressure of the just before period may be derived.

The air knife condition derivation unit 210 may derive the first air knife gap g1 and the final air knife pressure pf for the target coating weight by using the coating weight prediction model.

The coating weight prediction model may be represented as a function which has the operation condition, such as the line speed, the air knife gap, and the air knife pressure, as an input and the coating weight as an output. For example, the coating weight prediction model may be represented by Equation 1 that is the function which has the line speed V, the air knife gap G, the air knife pressure P, and the like, as an input and derives predicted coating weight CP as an output.

$$CP=F(V,G,P,\ldots) \quad \text{[Equation 1]}$$

The air knife condition derivation unit 210 may inversely calculate the coating weight prediction model to which the target coating weight is applied and derive the first air knife gap g1 and the final air knife pressure pf.

However, the invention is not limited thereto, and for example, the first air knife gap g1 and the final air knife pressure pf may be derived through the control by a regression model, or the first air knife gap g1 and the final air knife pressure pf may be derived based on the operation condition similar to the current operation condition among the accumulated operation conditions.

The air knife gap compensation unit 220 may determine a gap compensation ratio based on a result of the comparison between the control period and the pressure response time period. The air knife pressure in the plating operation is being continuously varied toward the final air knife pressure pf, so that when the gap compensation amount is applied 100% for each control period Tc, the air knife pressure varied for the control period Tc is not reflected. Then, the actual coating weight does not converge to the target coating weight, and a difference between the actual coating weight and the target coating weight may increase. Therefore, the gap compensation amount is determined in consideration of the control period and the pressure response.

Hereinafter, a method of calculating the final air knife gap of the coating weight control apparatus according to an exemplary embodiment will be described with reference to FIG. 2.

Figure 2:
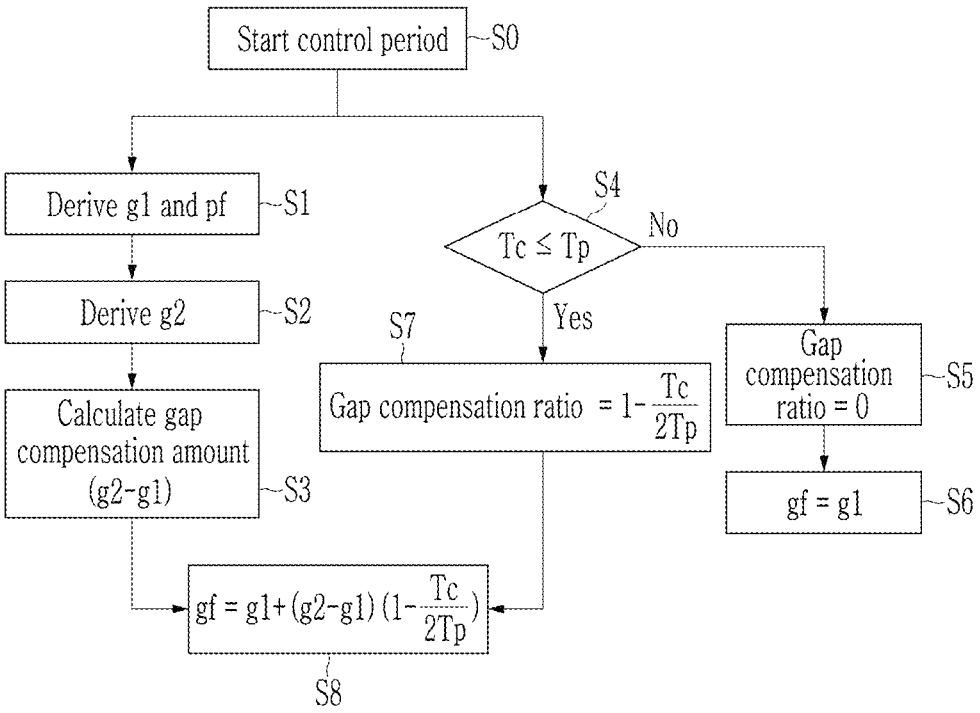
FIG. 2 is a flowchart illustrating a coating weight control method according to an exemplary embodiment.

FIG. 2 is a flowchart illustrating a coating weight control method according to an exemplary embodiment.

First, when a new control period Tc starts (operation S0), the air knife condition derivation unit 210 derives a first air knife gap g1 and a final air knife pressure pf for achieving a target coating weight by using the coating weight control model (operation S1). In this case, data for the target coating weight and the operation condition may be input to the air knife condition derivation unit 210.

The air knife condition derivation unit 210 derives a second air knife gap g2 for achieving the target coating weight under the current air knife pressure condition by using the coating weight control model (operation S2).

Subsequently, the air knife gap compensation unit 220 calculates a gap compensation amount (g2−g1) by subtracting the first air knife gap g1 from the second air knife gap g2 (operation S3).

In the meantime, the air knife gap compensation unit 220 compares the control period Tc and the pressure response time period Tp (operation S4).

When the control period Tc is longer than the pressure response time period Tp as a result of the comparison in operation S4, the gap compensation ratio is "0" (operation S5). Then, the final air knife gap pf is set with the first air knife gap 1 (operation S6).

When the control period Tc is equal to or shorter than the pressure response time period Tp as the result of the comparison in operation S4, the air knife gap compensation unit 220 calculates the gap compensation ratio based on a variation amount of the air knife pressure for the control period Tc (operation S7).

Figure 3:
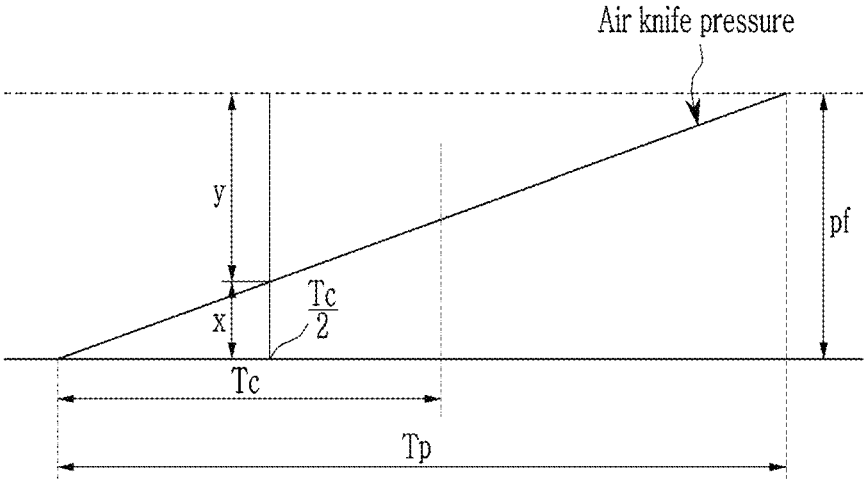
FIG. 3 is a graph illustrating a change in an air knife pressure for describing a method of calculating a gap compensation ratio.

FIG. 3 is a graph illustrating a change in an air knife pressure for describing a method of calculating a gap compensation ratio.

In FIG. 3, "X" represents a variation amount of the air knife pressure for the control period Tc. In the exemplary embodiment, the air knife pressure at an intermediate time point (Tc/2) of the control period Tc is set as the variation amount of the air knife pressure for the control period Tc. This is the value corresponding to an average of the air knife pressures for the control period Tc, and is an example applied to the exemplary embodiment, and the invention is not limited thereto.

In FIG. 3, "y" is a difference between the air knife pressure variation for the control period Tc and the air knife pressure p1, and in the exemplary embodiment, the gap compensation ratio is determined according to "y". In particular, the gap compensation ratio is y:p1, which may be represented by Equation 2.

$$(\text{Gap compensation ratio}) = 1 - \frac{Tc}{2Tp} \quad \text{[Equation 2]}$$

The gap compensation ratio according to the result of the comparison between the control period Tc and the pressure response time period Tp is organized by Equation 3.

$$(\text{Gap compensation ratio}) = 1 - \frac{Tc}{2Tp}, (Tp >= Tc) \quad \text{[Equation 3]}$$

$$(\text{Gap compensation ratio}) = 0, (Tp < Tc)$$

The air knife gap compensation unit 220 calculates a final air knife gap gf by multiplying the gap compensation amount calculated in operation S3 and the gap compensation ratio calculated in operation S7 (operation S8). The final air knife gap calculated in operation S8 may be represented by Equation 4.

$$\text{Final air knife gap } (gf) = g1 + (g2 - g1)\left(1 - \frac{Tc}{2Tp}\right) \quad \text{[Equation 4]}$$

The determined final air knife gap gf may be applied to the corresponding one between the air knives 121 and 122 together with the final air knife pressure pf. Otherwise, the same may be applied to both the air knives 121 and 122. Otherwise, another final air knife gap generated by the same method and the final air knife pressure may also be applied to the other air knife.

The air knife gap compensation ratio may be adjusted according to pressure response of air sprayed from the air knife. For example, the gap compensation ratio may be "0" in the case where air having a relatively short pressure response time period is used, and the gap compensation ratio may be "1−Tc/2Tp" in the case where nitrogen having a long pressure response time period is used.

In order to minimize a reverse effect by the compensation of the air knife gap, when the air knife pressure change rate is equal to or larger than a threshold rate within the control period Tc, the coating weight control apparatus 200 may calculate the air knife gap for reaching the target coating weight based on the current air knife pressure regardless of the control period Tc again and apply the calculated air knife gap.

There is a case where the air knife pressure sharply changes within the control period to be close to the target pressure. In this case, when the current air knife gap is maintained, a reverse effect by the gap compensation may occur. In order to prevent this, when the air knife pressure change rate within the control period Tc is equal to or larger than the threshold ratio, even though the control period Tc does not lapse yet, the air knife gap may be calculated again based on the current air knife pressure.

That is, when the control period Tc does not lapse yet, but the air knife pressure change rate is equal to or larger than the threshold ratio, the coating weight control apparatus 200 may newly derive an air knife gap for reaching the target coating weight with the current air knife pressure, and calculate a final air knife gap by multiplying a gap compensation amount that is a difference between the first air knife gap and the newly derived air knife gap by the gap compensation ratio.

Further, the final air knife gap is frequently changed by the gap compensation, so that a load of a motor which adjusts the air knife gap may be excessive.

Figure 4:
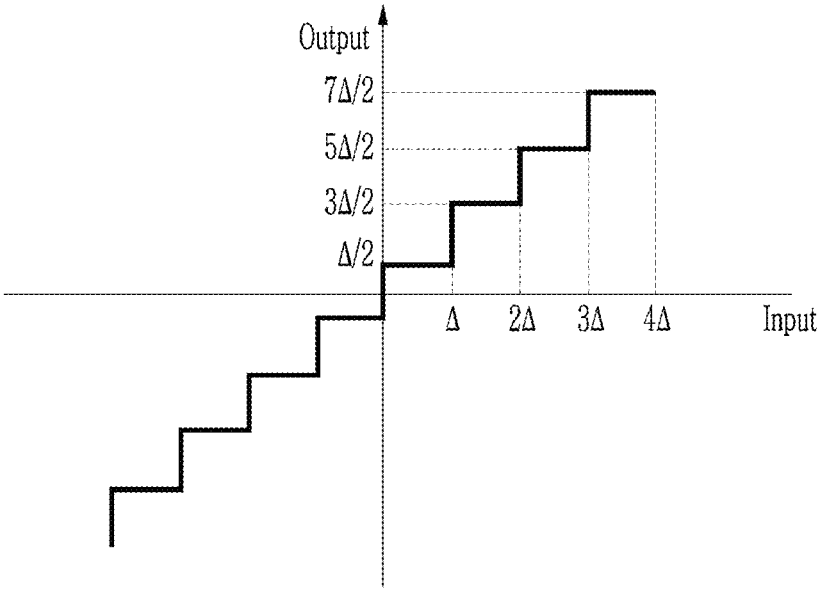
FIG. 4 is a graph illustrating an example of quantization.

In order to prevent this, in Equation 4, the load of the air knife gap adjusting motor may be reduced by quantizing the item "(g2−g1)*1−Tc/2Tp)" as illustrated in FIG. 4.

FIG. 4 is a graph illustrating an example of quantization.

As illustrated in FIG. 4, quantization of the equation that when a value of the item "(g2−g1)*(1−Tc/2Tp)" that is an input is 0~Δ, an output is Δ/2, when an input is Δ~2Δ, an output is 3Δ/2, when an input is 2Δ~3Δ, an output is 5Δ/2, and when an input is 3Δ~4Δ, an output is 7Δ/2 may be applied to the exemplary embodiment.

Figure 5:
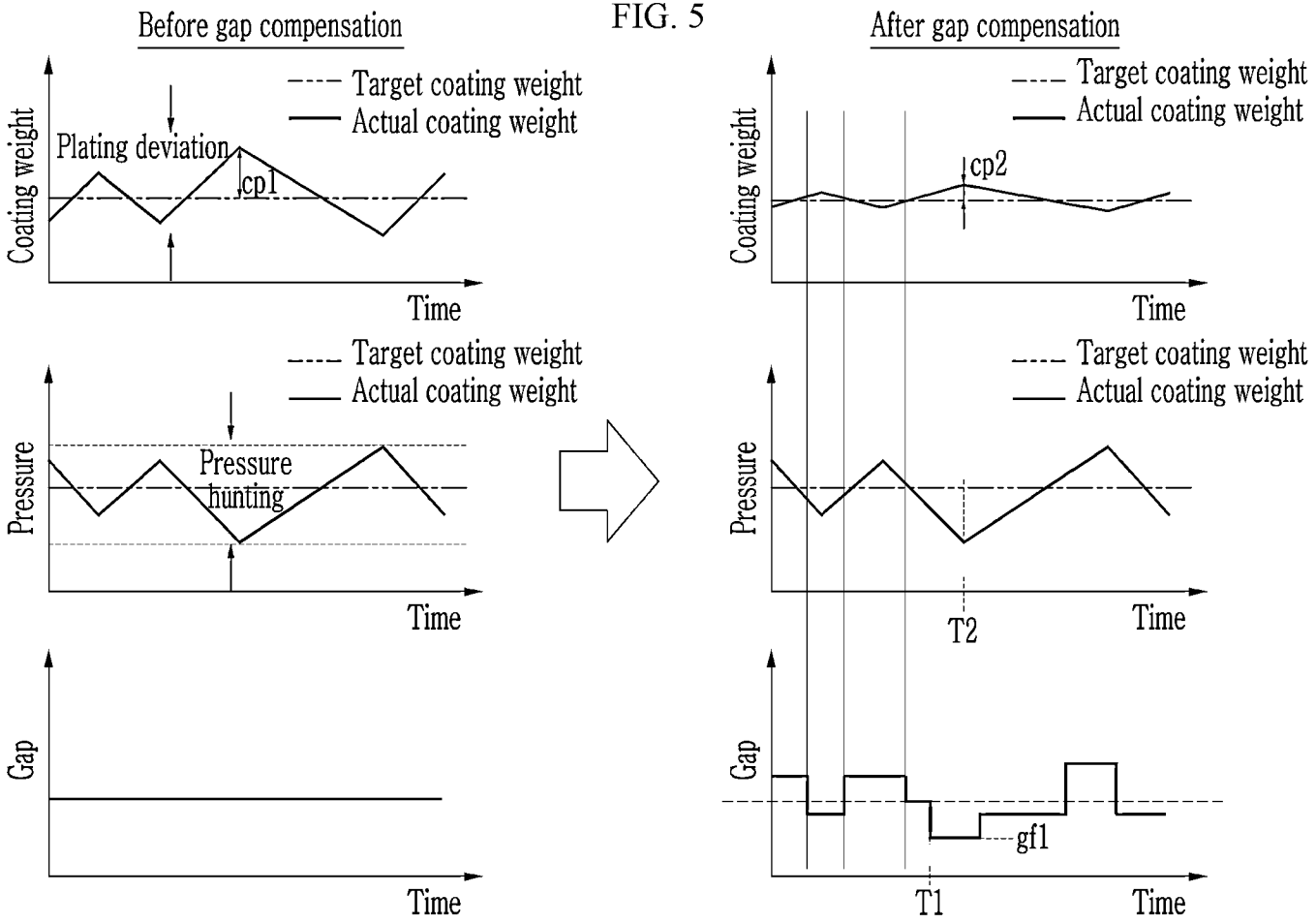
FIG. 5 is a graph illustrating coating weight, an air knife pressure, and an air knife gap representing the effect improved through the exemplary embodiment.

FIG. 5 is a graph illustrating coating weight, an air knife pressure, and an air knife gap representing the effect improved through the exemplary embodiment As illustrated in FIG. 5, it can be seen that compared to the case before the air knife gap compensation, the coating weight deviation after the compensation of the air knife gap may be sharply decreased.

Particularly, even at time point T2 at which pressure hunting occurs, a difference CP2 between the target coating weight and the actual coating weight is considerably smaller than the existing coating weight difference CP1. This is because the air knife gap is gf1 from the time point T1 according to the air knife gap compensation. That is, when the air knife pressure is reduced by the pressure hunting, the air knife gap is derived as a value for compensating for the reduced air knife pressure. Then, compared to the case in the related art in which the air knife gap is derived in accordance with the target pressure regardless of the pressure hunting, the air knife gap is compensated according to the pressure change, so that the sharp coating weight deviation by the pressure hunting may be reduced through the air knife gap compensation.

The coating weight control system in the related art has a problem in that, the gap of the air knife follows an indication value within several seconds, and it takes several tens of seconds to several minutes for the air knife pressure to reach the indication value according to response performance. That is, the time taken for the actual coating weight to follow the target coating weight is the time taken for the air knife pressure to follow the indication value. Then, even though the optimum air knife gap and pressure for the target coating weight are calculated, the actual air knife pressure is not accurately reflected, resulting in degrading coating weight control consistency. In the exemplary embodiment, it is possible to improve coating weight control consistency without building a separate pressure control facility, and additional costs and management are not required.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

The invention claimed is:

1. An apparatus for controlling coating weight of a steel sheet by using two air knives, the apparatus comprising:

an air knife condition derivation unit configured to derive a first air knife gap and a final air knife pressure for target coating weight, and derive a second air knife gap for achieving the target coating weight at a current air knife pressure;

an air knife pressure response compensation unit configured to determine a final air knife gap according to a gap compensation amount that is a difference between the second air knife gap and the first air knife gap and a gap compensation ratio based on an air knife pressure variation amount for a control period; and a wiping part configured to receive the final air knife pressure from the air knife condition derivation unit and the final air knife gap from the air knife gap compensation unit and control the two air knives according to the final air knife pressure and the final air knife gap so that the target coating weight is achieved, wherein the control period is a period for updating an air knife condition for the target coating weight, wherein, when the control period is longer than the pressure response time period, the air knife pressure response compensation unit sets the gap compensation ratio to zero, wherein, when the control period is equal to or shorter than a pressure response time period, the air knife gap compensation unit further configured to calculate the gap compensation ratio based on the air knife pressure variation amount for the control period and a value obtained by dividing the control period by the pressure response time period, multiply the gap compensation amount and the gap compensation ratio, and determine the final air knife gap by adding the value obtained by the multiplication to the first air knife gap, and wherein the pressure response time period is the time period for which the current air knife pressure reaches the final air knife pressure.

2. The apparatus of claim 1, wherein:

the gap compensation ratio follows an equation below, $$(\text{gap compensation ratio})=1-Tc/2Tp,(Tp>=Tc)$$

$$(\text{gap compensation ratio})=0,(Tp<Tc),$$

Tc is the control period, and Tp is the pressure response time period.

3. The apparatus of claim 1, wherein:

the air knife gap compensation unit is further configured to add a quantization result of the value obtained by the multiplication to the first air knife gap.

4. The apparatus of claim 1, wherein:

when an air knife pressure change rate within one control period is equal to or larger than a predetermined threshold rate, the air knife gap compensation unit derives is configured to derive a third air knife gap for reaching the target coating weight at a current air knife pressure, and determines a final air knife gap according to a gap compensation amount that is a difference between the third air knife gap and the first air knife gap and the gap compensation ratio.

5. A method of controlling coating weight of a steel sheet by using two air knives, the method comprising:

deriving, by a coating weight control apparatus, a first air knife gap and a final air knife pressure for target coating weight;

deriving, by the coating weight control apparatus, a second air knife gap for achieving the target coating weight at a current air knife pressure;

calculating, by the coating weight control apparatus, a gap compensation amount that is a difference between the second air knife gap and the first air knife gap;

calculating, by the coating weight control apparatus, a gap compensation ratio based on an air knife pressure variation amount for a control period;

determining, by the coating weight control apparatus, a final air knife gap based on the gap compensation amount and the gap compensation ratio; and transmitting the final air knife pressure and the final air knife gap to a wiping part for controlling the two air knives so that the target coating weight is achieved, wherein the control period is a period for updating an air knife condition for the target coating weight, wherein the calculating of the gap compensation ratio includes:

when the control period is longer than the pressure response time period, setting the gap compensation ratio to zero, and when the control period is equal to or shorter than a pressure response time period, calculating the gap compensation ratio based on the air knife pressure variation amount for the control period and a value obtained by dividing the control period by the pressure response time period, multiplying the gap compensation amount and the gap compensation ratio, and determining the final air knife gap by adding the value obtained by the multiplication to the first air knife gap, and wherein the pressure response time period is the time period for which the current air knife pressure reaches the final air knife pressure.

6. The method of claim 5, wherein:

the gap compensation ratio follows an equation below, $$(\text{gap compensation ratio})=1-Tc/2Tp,(Tp>=Tc)$$

$$(\text{gap compensation ratio})=0,(Tp<Tc),$$

Tc is the control cycle, and Tp is the pressure response time period.

7. The method of claim 5, wherein:

the determining of the final air knife gap includes: adding a quantization result of the value obtained by the multiplication to the first air knife gap to determine the final air knife gap.

8. The method of claim 5, further comprising:

when an air knife pressure change rate within one control cycle is equal to or larger than a predetermined threshold rate, deriving a third air knife gap for reaching the target coating weight at a current air knife pressure; and determining a final air knife gap according to a gap compensation amount that is a difference between the third air knife gap and the first air knife gap and the gap compensation ratio.

* * * * *